US010385622B2

(12) United States Patent
Voglewede et al.

(10) Patent No.: US 10,385,622 B2
(45) **Date of Patent: *Aug. 20, 2019**

(54) PRECIPITATION HARDENED MATRIX DRILL BIT

(71) Applicant: Halliburton Energy Services, Inc., Houston, TX (US)

(72) Inventors: Daniel Brendan Voglewede, Spring, TX (US); Garrett T. Olsen, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 681 days.

This patent is subject to a terminal disclaimer.

(21) Appl. No.: 14/764,487

(22) PCT Filed: Sep. 18, 2014

(86) PCT No.: PCT/US2014/056358

§ 371 (c)(1),
(2) Date: Jul. 29, 2015

(87) PCT Pub. No.: WO2016/043759

PCT Pub. Date: Mar. 24, 2016

(65) Prior Publication Data

US 2016/0265284 A1 Sep. 15, 2016

(51) Int. Cl.
*E21B 10/54* (2006.01)
*B22F 3/24* (2006.01)
(Continued)

(52) U.S. Cl.
CPC ..... *E21B 10/54* (2013.01); *B22F 3/24* (2013.01); *B22F 7/062* (2013.01); *C22C 9/06* (2013.01);
(Continued)

(58) Field of Classification Search
CPC ..... E21B 10/42; E21B 10/54; E21B 10/55
See application file for complete search history.

(56) References Cited

U.S. PATENT DOCUMENTS 4,853,182 A 8/1989 Cornie et al.
5,172,780 A 12/1992 Batliner et al.
(Continued)

FOREIGN PATENT DOCUMENTS

JP 63307240 A * 12/1988
WO 2003049889 A2 6/2003
WO 2011005403 A1 1/2011

OTHER PUBLICATIONS

International Search Report and Written Opinion for PCT/US2014/056358 dated May 29, 2015.
(Continued)

*Primary Examiner* — D. Andrews
(74) *Attorney, Agent, or Firm* — Alan Bryson; C. Tumey Law Group PLLC

(57) ABSTRACT

Forming a precipitation hardened composite material having reinforcing particles and precipitated intermetallic particles dispersed in the binder material may involve heat treating the hard composite material at a temperature above a solvus line for the binder material and below a melting point of the binder material and quenching the hard composite material to a temperature below the solvus line of the binder material. At least some of the precipitated intermetallic particles in the precipitation hardened composite material may have at least one dimension less than 1 micron. Such precipitated intermetallic particles may optionally be grown to larger sizes by heat treating the precipitation hardened composite material at a temperature below the solvus line of the binder material.

9 Claims, 5 Drawing Sheets

(51) Int. Cl.

| | |
|---|---|
| ***B22F 7/06*** | (2006.01) |
| ***C22C 9/06*** | (2006.01) |
| ***C22C 30/02*** | (2006.01) |
| ***C22F 1/08*** | (2006.01) |
| ***E21B 10/42*** | (2006.01) |
| *C22C 26/00* | (2006.01) |
| *B22F 5/00* | (2006.01) |
| *E21B 10/55* | (2006.01) |

(52) U.S. Cl.

CPC ..... *C22C 30/02* (2013.01); *C22F 1/08* (2013.01); *E21B 10/42* (2013.01); *B22F 2003/248* (2013.01); *B22F 2005/001* (2013.01); *B22F 2007/066* (2013.01); *B22F 2303/15* (2013.01); *C22C 26/00* (2013.01); *E21B 10/55* (2013.01)

(56) References Cited

U.S. PATENT DOCUMENTS

| | | | |
|---|---|---|---|
| 5,880,382 | A | 3/1999 | Fang et al. |
| 6,116,360 | A | 9/2000 | Evans |
| 6,148,936 | A | 11/2000 | Evans et al. |
| 6,348,110 | B1 | 2/2002 | Evans |
| 7,556,668 | B2 | 7/2009 | Eason et al. |
| 7,691,173 | B2 | 4/2010 | Eason et al. |
| 7,879,159 | B2 | 2/2011 | Wright et al. |
| 7,913,779 | B2 | 3/2011 | Choe et al. |
| 8,074,750 | B2 | 12/2011 | Choe et al. |
| 8,087,324 | B2 | 1/2012 | Eason et al. |
| 8,172,914 | B2 | 5/2012 | Mirchandani et al. |
| 8,230,762 | B2 | 7/2012 | Choe et al. |
| 8,287,669 | B2 | 10/2012 | Kaneko et al. |
| 8,561,731 | B2 | 10/2013 | Keshavan et al. |
| 8,616,851 | B2 | 12/2013 | DiDomizio et al. |
| 8,641,840 | B2 | 2/2014 | Branagan et al. |
| 9,752,204 | B2 * | 9/2017 | Voglewede ..... C21D 1/18 |
| 2004/0033158 | A1 | 2/2004 | Chiba et al. |
| 2006/0278308 | A1 | 12/2006 | Shankar et al. |
| 2008/0128176 | A1 | 6/2008 | Choe et al. |
| 2008/0185078 | A1 * | 8/2008 | Ishida ..... C22C 19/07 148/674 |
| 2010/0006345 | A1 | 1/2010 | Stevens |
| 2010/0133805 | A1 | 6/2010 | Stevens et al. |
| 2010/0319492 | A1 | 12/2010 | Smith et al. |
| 2011/0142707 | A1 | 6/2011 | Choe et al. |
| 2013/0000982 | A1 | 1/2013 | Olsen |
| 2013/0180786 | A1 | 7/2013 | Thomas et al. |
| 2013/0288049 | A1 | 10/2013 | Sample et al. |

OTHER PUBLICATIONS

Zhang et al., High Strength Nanostructured Materials and Their Oil Filed Applications, SPE 157092, 2012.

* cited by examiner

PRECIPITATION HARDENED MATRIX DRILL BIT

BACKGROUND

The present disclosure relates to matrix bit bodies, including methods of production and use related thereto.

Rotary drill bits are frequently used to drill oil and gas wells, geothermal wells and water wells. Rotary drill bits may be generally classified as roller cone drill bits or fixed cutter drill bits. Fixed cutter drill bits are often formed with a matrix bit body having cutting elements or inserts disposed at select locations about the exterior of the matrix bit body. During drilling, these cutting elements engage and remove adjacent portions of the subterranean formation.

The composite materials used to form the matrix bit body are generally erosion-resistant and have high impact strengths. However, defects in the composite materials formed during manufacturing of the matrix bit body can reduce the lifetime of the drill bit.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
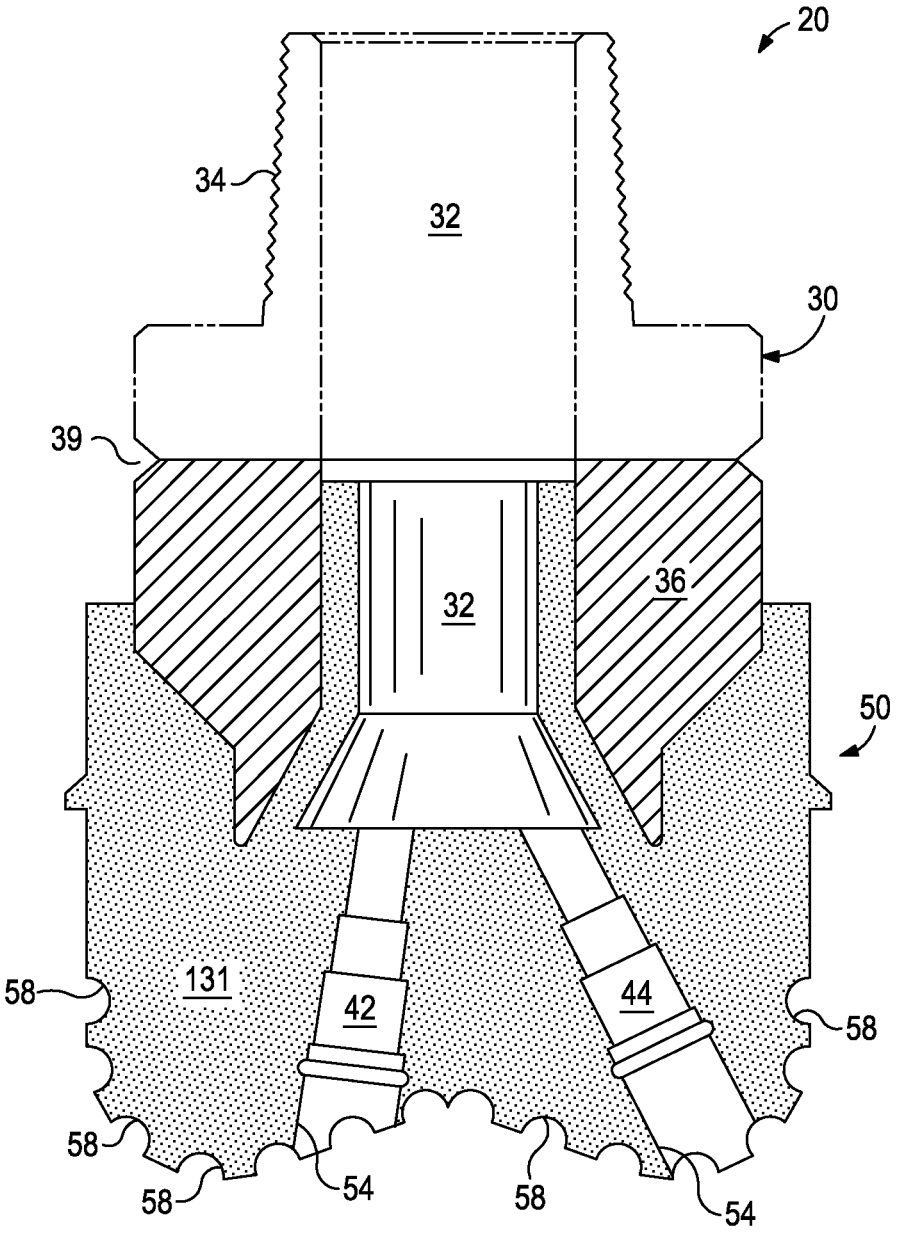
FIG. 1 is a cross-sectional view showing one example of a drill bit having a matrix bit body with at least one fiber-reinforced portion in accordance with the teachings of the present disclosure.

The present disclosure relates to a drill bit having a matrix bit body comprising precipitation hardened composite material, including methods of production and use related thereto. The teachings of this disclosure can be applied to any downhole tool that can be formed at least partially of composite materials described herein that include reinforcing particles dispersed in a binder material. Such tools may include tools for drilling wells, completing wells, and producing hydrocarbons from wells. Examples of such tools include cutting tools, such as drill bits, reamers, stabilizers, and coring bits; drilling tools, such as rotary steerable devices and mud motors; and other tools used downhole, such as window mills, packers, tool joints, and other wear-prone tools.

In some embodiments, the matrix bit bodies of the present disclosure are formed, at least in part, with a precipitation hardened composite material that includes reinforcing particles (such as metal carbides) and precipitated intermetallic particles dispersed in a binder material continuous phase. As use herein, the term "precipitated intermetallic particle" refers to a particle that includes two or more metals that are precipitated from the binder material after infiltration of the reinforcing particles with the binder material wherein the precipitated metals are not in the form of a carbide.

In some embodiments, at least some of the reinforcing particles may have a diameter of 1 micron or greater, and at least some of the precipitated intermetallic particles may be less than 1 micron in at least one dimension. The smaller-sized precipitated intermetallic particles may enhance the strength of the matrix bit body while the larger-sized reinforcing particles may provide erosion resistance to the matrix bit body.

In other matrix bit body forming procedures, both small and large reinforcing particles may be used to provide erosion resistance and strength, respectively. However, in some instances, the differently sized reinforcing particles may tend to segregate before infiltration with the binder material. Then, when the reinforcing particles are infiltrated with the binder material and locked in place, the segregation may result in portions of the matrix bit body that exhibit less strength (i.e., fewer large particles) and portions that exhibit less erosion resistance (i.e., fewer small particles). The variations in erosion resistance and strength within the matrix bit body provide failure points that reduce the lifetime of the drill bit.

By forming the smaller particles in situ (i.e., via the precipitation methods described herein), the smaller particles may be distributed more homogeneously throughout the precipitation hardened composite material as compared to a hard composite formed from mixed-sized reinforcing particles. Accordingly, the precipitation hardened composite material described herein may provide similar enhancements in erosion resistance and strength while mitigating the failure points associated with segregation of mixtures of large-sized and small-sized reinforcing particles.

FIG. 1 is a cross-sectional view of a matrix drill bit 20 having a matrix bit body 50 formed by a precipitation hardened composite material 131 with reinforcing particles and precipitated intermetallic particles dispersed in a binder material. As used herein, the term "matrix drill bit" encompasses rotary drag bits, drag bits, fixed cutter drill bits, and any other drill bit having a matrix bit body and capable of incorporating the teachings of the present disclosure.

For embodiments such as those shown in FIG. 1, the matrix drill bit 20 may include a metal shank 30 with a metal blank 36 securely attached thereto (e.g., at weld location 39). The metal blank 36 extends into matrix bit body 50. The metal shank 30 includes a threaded connection 34 distal to the metal blank 36.

The metal shank 30 and metal blank 36 are generally cylindrical structures that at least partially define corresponding fluid cavities 32 that fluidly communicate with each other. The fluid cavity 32 of the metal blank 36 may further extend longitudinally into the matrix bit body 50. At least one flow passageway (shown as two flow passageways 42 and 44) may extend from the fluid cavity 32 to exterior portions of the matrix bit body 50. Nozzle openings 54 may be defined at the ends of the flow passageways 42 and 44 at the exterior portions of the matrix bit body 50.

Figure 2:
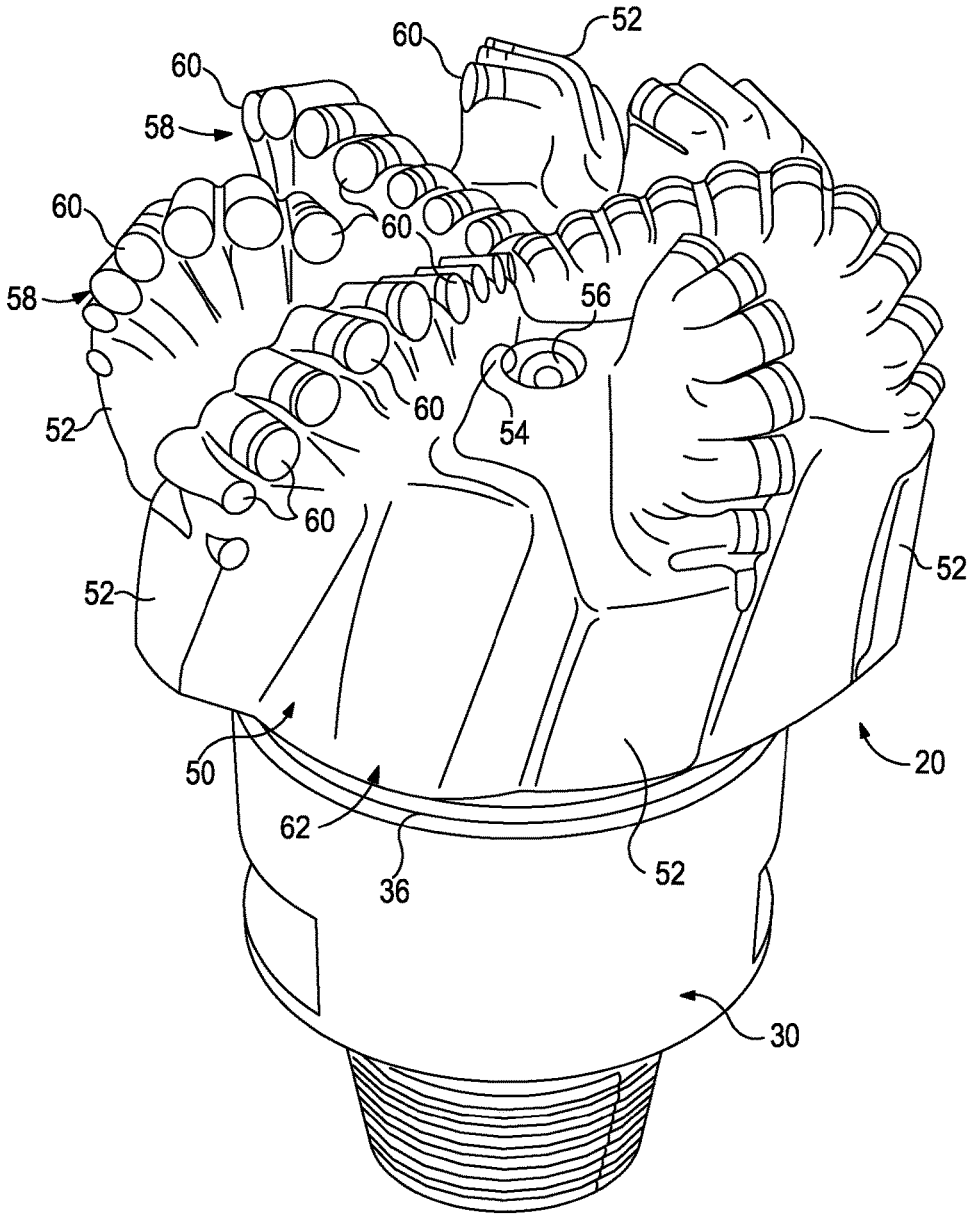
FIG. 2 is an isometric view of the drill bit of FIG. 1.

A plurality of indentations or pockets 58 are formed in the matrix bit body 50 and are shaped or otherwise configured to receive cutting elements (shown in FIG. 2).

FIG. 2 is an isometric view of the matrix drill bit 20 formed with the matrix bit body 50 that includes a precipitation hardened composite material in accordance with the teachings of the present disclosure. As illustrated, the matrix drill bit 20 includes the metal blank 36 and the metal shank 30, as generally described above with reference to FIG. 1.

The matrix bit body 50 includes a plurality of cutter blades 52 formed on the exterior of the matrix bit body 50. Cutter blades 52 may be spaced from each other on the exterior of the matrix bit body 50 to form fluid flow paths or junk slots 62 therebetween.

As illustrated, the plurality of pockets 58 may be formed in the cutter blades 52 at selected locations. A cutting element 60 (alternatively referred to as a cutting insert) may be securely mounted (e.g., via brazing) in each pocket 58 to engage and remove portions of a subterranean formation during drilling operations. More particularly, the cutting elements 60 may scrape and gouge formation materials from the bottom and sides of a wellbore during rotation of the matrix drill bit 20 by an attached drill string. For some applications, various types of polycrystalline diamond compact (PDC) cutters may be used as cutting elements 60. A matrix drill bit having such PDC cutters may sometimes be referred to as a "PDC bit".

A nozzle 56 may be disposed in each nozzle opening 54. For some applications, nozzles 56 may be described or otherwise characterized as "interchangeable" nozzles.

Figure 3:
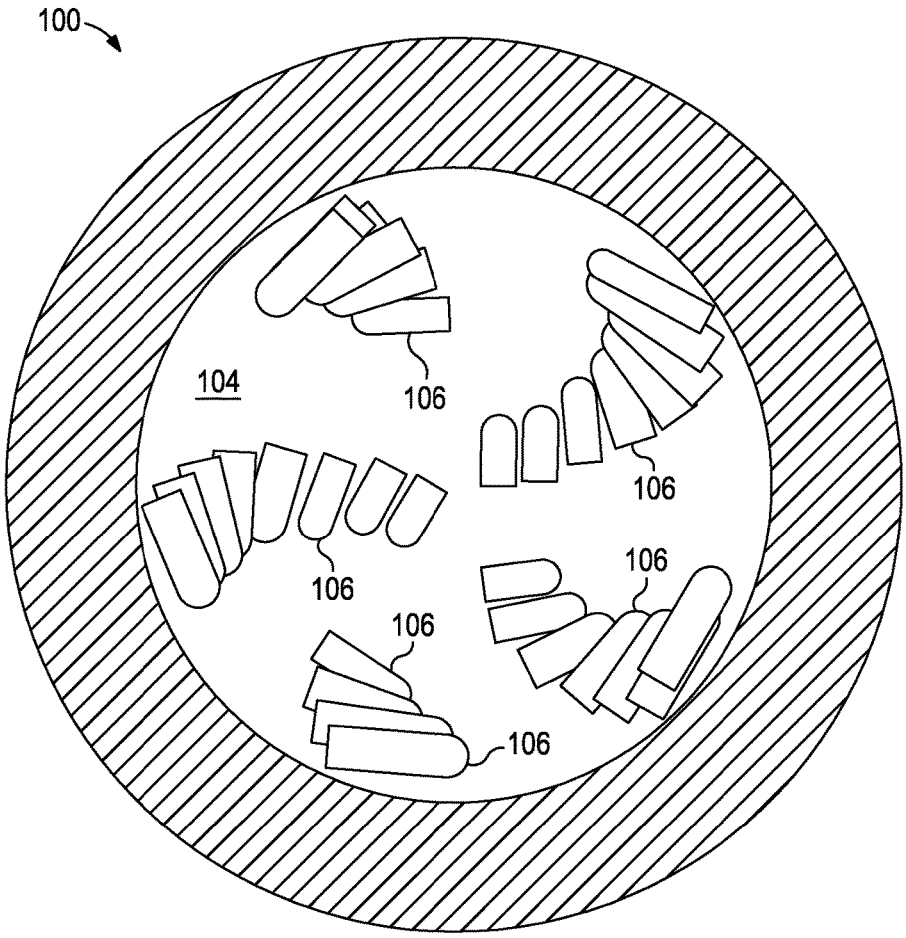
FIG. 3 is a cross-sectional view showing one example of a mold assembly for use in forming a matrix bit body in accordance with the teachings of the present disclosure.

FIG. 3 is an end view showing one example of a mold assembly 100 for use in forming a matrix bit body incorporating teachings of the present disclosure. A plurality of mold inserts 106 may be placed within the cavity 104 of the mold assembly 100 to form the respective pockets in each blade of the matrix bit body. The location of mold inserts 106 in cavity 104 corresponds with desired locations for installing the cutting elements in the associated blades. Mold inserts 106 may be formed from various types of material such as, but not limited to, consolidated sand and graphite.

Various types of temporary materials may be installed within mold cavity 104, depending upon the desired configuration of a resulting matrix drill bit. Additional mold inserts (not expressly shown) may be formed from various materials such as consolidated sand and/or graphite may be disposed within mold cavity 104. Such mold inserts may have configurations corresponding to the desired exterior features of the matrix drill bit (e.g., junk slots).

Figure 4:
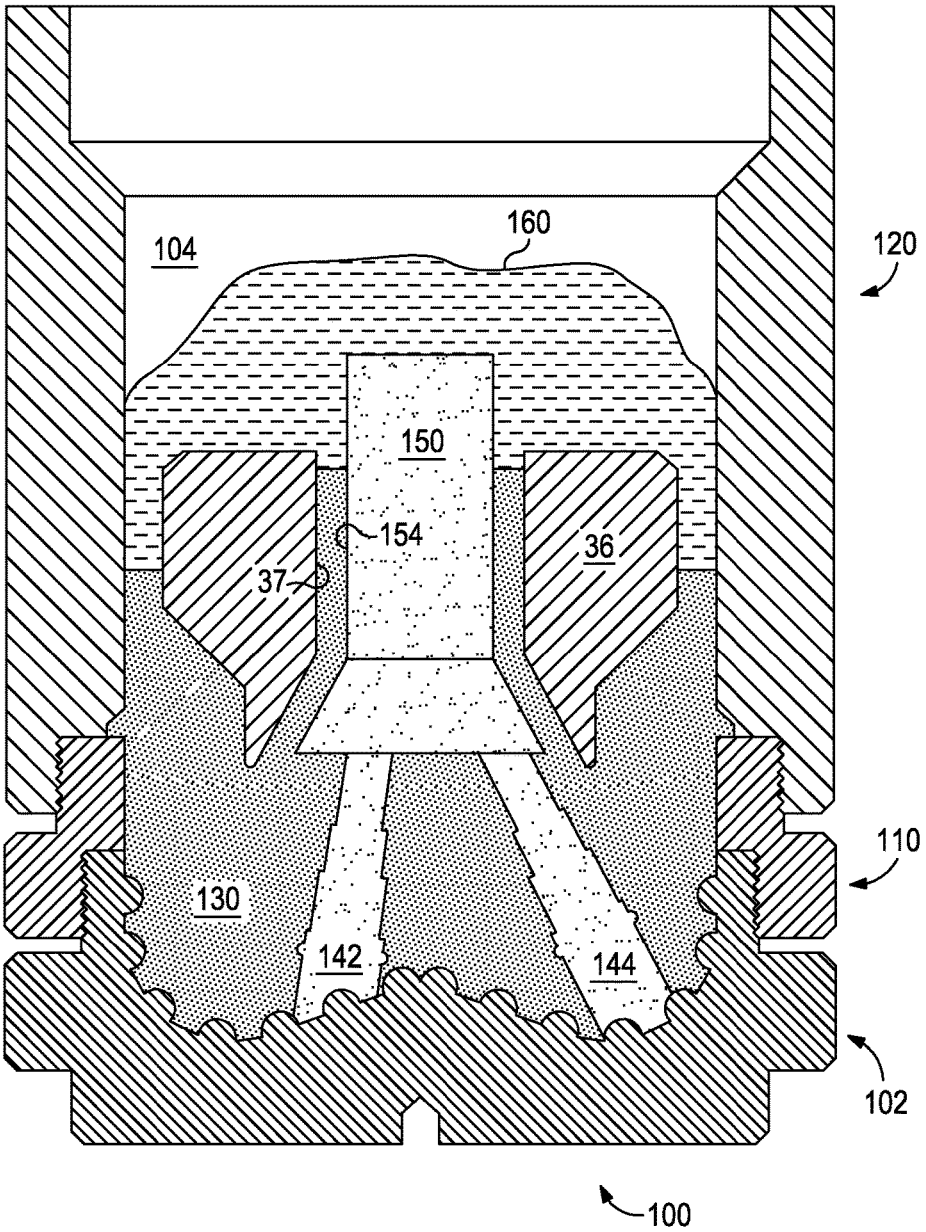
FIG. 4 is an end view showing one example of a mold assembly for use in forming a matrix bit body in accordance with the teachings of the present disclosure.

FIG. 4 is a cross-sectional side view of the mold assembly 100 of FIG. 3 that may be used in forming a matrix bit body incorporating the teachings of the present disclosure. A wide variety of molds may be used to form a matrix bit body in accordance with the teachings of the present disclosure.

The mold assembly 100 may include several components such as a mold 102, a gauge ring or connector ring 110, and a funnel 120. Mold 102, gauge ring 110, and funnel 120 may be formed from graphite, for example, or other suitable materials. A cavity 104 may be defined or otherwise provided within the mold assembly 100. Various techniques may be used to manufacture the mold assembly 100 and components thereof including, but not limited to, machining a graphite blank to produce the mold 102 with the associated cavity 104 having a negative profile or a reverse profile of desired exterior features for a resulting matrix bit body. For example, the cavity 104 may have a negative profile that corresponds with the exterior profile or configuration of the blades 52 and the junk slots 62 formed therebetween, as shown in FIGS. 1-2.

Referring still to FIG. 4, materials (e.g., consolidated sand) may be positioned within the mold assembly 100 at desired locations to form the exterior features of the matrix drill bit (e.g., the fluid cavity and the flow passageways). Such materials may have various configurations. For example, the orientation and configuration of the consolidated sand legs 142 and 144 may be selected to correspond with desired locations and configurations of associated flow passageways and their respective nozzle openings. The consolidated sand legs 142 and 144 may be coupled to threaded receptacles (not expressly shown) for forming the threads of the nozzle openings that couple the respective nozzles thereto.

A relatively large, generally cylindrically-shaped consolidated sand core 150 may be placed on the legs 142 and 144. Core 150 and legs 142 and 144 may be sometimes described as having the shape of a "crow's foot," and core 150 may be referred to as a "stalk." The number of legs 142 and 144 extending from core 150 will depend upon the desired number of flow passageways and corresponding nozzle openings in a resulting matrix bit body. The legs 142 and 144 and the core 150 may also be formed from graphite or other suitable materials.

After the desired materials, including the core 150 and legs 142 and 144, have been installed within mold assembly 100, the reinforcing particles 130 may then be placed within or otherwise introduced into the mold assembly 100. After a sufficient volume of the reinforcing particles 130 has been added to the mold assembly 100, a metal blank 36 may then be placed within mold assembly 100. The amount of reinforcing particles 130 added to the mold assembly 100 before addition of the metal blank 36 depends on the configuration of the metal blank 36 and the desired positioning of the metal blank 36 within the mold assembly 100. Typically, the metal blank 36 is supported at least partially by the reinforcing particles 130.

The metal blank 36 preferably includes an inside diameter 37, which is larger than the outside diameter 154 of sand core 150. Various fixtures (not expressly shown) may be used to position the metal blank 36 within the mold assembly 100 at a desired location. Then, the reinforcing particles 130 may be filled to a desired level within the cavity 104.

Binder material 160 may be placed on top of the reinforcing particles 130, metal blank 36, and core 150. In some embodiments, the binder material 160 may be covered with a flux layer (not expressly shown). The amount of binder material 160 and optional flux material added to cavity 104 should be at least enough to infiltrate the reinforcing particles 130 during the infiltration process. In some instances, excess binder material 160 may be used, which, after infiltration, may be removed by machining.

A cover or lid (not expressly shown) may be placed over the mold assembly 100. The mold assembly 100 and materials disposed therein may then be preheated and then placed in a furnace (not expressly shown). When the furnace temperature reaches the melting point of the binder material 160, the binder material 160 may proceed to liquefy and infiltrate the reinforcing particles 130.

After a predetermined amount of time allotted for the liquefied binder material 160 to infiltrate reinforcing particles 130, the mold assembly 100 may then be cooled, thereby producing a hard composite material (i.e., reinforcing particles infiltrated with binder material) (not shown). Once cooled, the mold assembly 100 may be broken away to expose the matrix bit body that includes the hardened composite material. Then, the hard composite material or a portion thereof may be exposed to a precipitation treatment designed to precipitate intermetallic particles from the binder material, thereby producing a precipitation hardened composite material. Additional processing and machining according to well-known techniques may be used to produce a matrix drill bit that includes the matrix bit body formed at least in part by the precipitation hardened composite material.

The conditions of a precipitation treatment suitable for precipitating intermetallic particles from the binder material may depend on, inter alia, the particular composition of the binder material, the desired size range of the precipitated intermetallic particles, the size of the matrix bit body, the amount of the hardened composite material to be converted to a precipitation hardened composite material, and the like.

Generally, the precipitation treatment involves a solutioning step where the hardened composite material or a portion thereof is reheated to a temperature that is above the solvus line and below the melting point for the binder material. As used herein, the term "solvus line" refers to the line on a phase diagram that separates a homogenous solid solution from a field of several phases that may form by exsolution or incongruent melting. Heating above the solvus line may dissolve any large intermetallic precipitate that formed at the grain boundaries when cooling the hardened composition material after infiltration.

In some instances, the temperature of the solutioning step (i.e., the temperature above the solvus line and below the melting point for the binder material) may be between 900° F. (482° C.) and 1500° F. (815° C.).

In some instances, the hardened composite material or a portion thereof may be maintained at a temperature above the solvus line and below the melting point for the binder material for an extended period of time (e.g., 1 hour to 4 hours).

A furnace, an induction coil, or the like may be used for the solutioning step. In some instances, the solutioning step may be performed during brazing of the hardened composite material where once brazing is complete the additional steps of the precipitation treatment are performed.

After the solutioning step, the hardened composite material or a portion thereof may be rapidly quenched (e.g., in less than about 30 minutes, which may depend on the size of the hardened composite material or a portion thereof) to a temperature below the solvus line, thereby forming precipitated intermetallic particles dispersed throughout the binder material. Without being limited by theory, it is believed that rapidly quenching the hardened composite material from above the solvus line to below the solvus line forms precipitated intermetallic particles dispersed throughout the binder material rather than preferentially at the grain boundaries. This dispersion of precipitated intermetallic particles, as opposed to being located grain boundaries, may provide enhanced strength in the resultant precipitation hardened composite material.

Rapid quenching may be performed by contacting the heated hardened composite material or a portion thereof with a liquid medium (e.g., water, salt water, brine, oil, mineral oil, liquid polymers, polymer solutions, and the like).

The precipitated intermetallic particles formed by the rapid quenching may initially be small (e.g., less than about 20 nm). In some embodiments, however, larger precipitated intermetallic particles may be desired. Therefore, in some embodiments, precipitation hardened composite material or a portion thereof may be maintained at a temperature below the solvus line of the binder material for a period of time (e.g., 1 hour to 10 hours) to allow the precipitated intermetallic particles to grow. In some instances, the rapid quench across the solvus line may be performed to the temperature desired for the precipitated particle growth step. In alternate embodiments, the rapid quench across the solvus line may be performed to room temperature, and then, the precipitation hardened composite material or a portion thereof having the small precipitated intermetallic particles may be reheated to perform the precipitated particle growth step.

In some instances, the temperature during the precipitated particle growth step may be 10° F. to 50° F. (5° C. to 30° C.) below the solvus line of the binder material. The closer the temperature is to the solvus line during the precipitated particle growth step, the faster the precipitated particles will grow. In some instances, the temperature below the solvus line of the binder material during precipitated particle growth step may be between 500° F. (260° C.) and 1000° F. (538° C.).

In some embodiments, at least some of the precipitated intermetallic particles may have a size in at least one dimension ranging from a lower limit of 1 nm, 10 nm, 20 nm, or 50 nm to an upper limit of 1 micron, 500 nm, 250 nm, or 100 nm, and wherein the size in at least one dimension may range from any lower limit to any upper limit and encompasses any subset therebetween. For example, at least some of the precipitated intermetallic particles may be elongated particles with a length ranging from 1 nm to 1 micron, including any subset therebetween. In another example, at least some of the precipitated intermetallic particles may be substantially spherical with a diameter ranging from 1 nm to 1 micron, including any subset therebetween. In some embodiments, the precipitated intermetallic particles may be grown to larger sizes (e.g., 10 microns or larger).

After the precipitated particle growth step, the precipitation hardened composite material or a portion thereof may be cooled to lock the size and location of the precipitated intermetallic particles in place. In some instances, the final cooling step may be a fast quench. In alternate embodiments, the final cooling step may be slower, which may allow for further growth of the precipitated intermetallic particles.

In some embodiments, the precipitation hardened composite material or a portion thereof may include precipitated intermetallic particles dispersed in the binder material such that less than 10% of the precipitated intermetallic particles (by number) are located at grain boundaries within the binder material, which may be determined by microscopy techniques.

Examples of binder materials suitable for use in conjunction with the embodiments described herein may include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Nonlimiting examples of binder materials may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof.

Examples of commercially available binder materials may include, but not be limited to, VIRGIN™ Binder 453D (copper-manganese-nickel-zinc, available from Belmont Metals, Inc.); copper-tin-manganese-nickel and copper-tin-manganese-nickel-iron grades 516, 519, 523, 512, 518, and 520 available from ATI Firth Sterling; and any combination thereof.

In some embodiments, at least some of the precipitated intermetallic particles may include a transition metal. In some embodiments, at least some of the precipitated intermetallic particles may include at least two of manganese, nickel, copper, aluminum, titanium, iron, chromium, zinc, vanadium, or the like. For example, precipitated intermetallic particles may include CuM, $Cu_3M$, or both, where M is a transition metal (e.g., the foregoing transition metals).

In some instances, reinforcing particles suitable for use in conjunction with the embodiments described herein may include particles of metals, metal alloys, metal carbides, metal nitrides, diamonds, superalloys, and the like, or any combination thereof. Examples of reinforcing particles suitable for use in conjunction with the embodiments described herein may include particles that include, but not be limited to, nitrides, silicon nitrides, boron nitrides, cubic boron nitrides, natural diamonds, synthetic diamonds, cemented carbide, spherical carbides, low alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbides, macrocrystalline tungsten carbides, cast tungsten carbides, crushed sintered tungsten carbides, carburized tungsten carbides, steels, stainless steels, austenitic steels, ferritic steels, martensitic steels, precipitation-hardening steels, duplex stainless steels, ceramics, iron alloys, nickel alloys, chromium alloys, HASTELLOY® alloys (nickel-chromium containing alloys, available from Haynes International), INCONEL® alloys (austenitic nickel-chromium containing superalloys, available from Special Metals Corporation), WASPALOYS® (austenitic nickel-based superalloys, available from United Technologies Corp.), RENE® alloys (nickel-chrome containing alloys, available from Altemp Alloys, Inc.), HAYNES® alloys (nickel-chromium containing superalloys, available from Haynes International), INCOLOY® alloys (iron-nickel containing superalloys, available from Mega Mex), MP98T (a nickel-copper-chromium superalloy, available from SPS Technologies), TMS alloys, CMSX® alloys (nickel-based superalloys, available from C-M Group), N-155 alloys, any mixture thereof, and any combination thereof. In some embodiments, the reinforcing particles may be coated. By way of nonlimiting example, the reinforcing particles may include diamond coated with titanium.

In some embodiments, at least some of the reinforcing particles described herein may have a diameter ranging from a lower limit of 1 micron, 10 microns, 50 microns, or 100 microns to an upper limit of 3000 microns, 2000 microns, 1000 microns, 800 microns, 500 microns, 400 microns, or 200 microns, wherein the diameter of the reinforcing particles may range from any lower limit to any upper limit and encompasses any subset therebetween.

Figure 5:
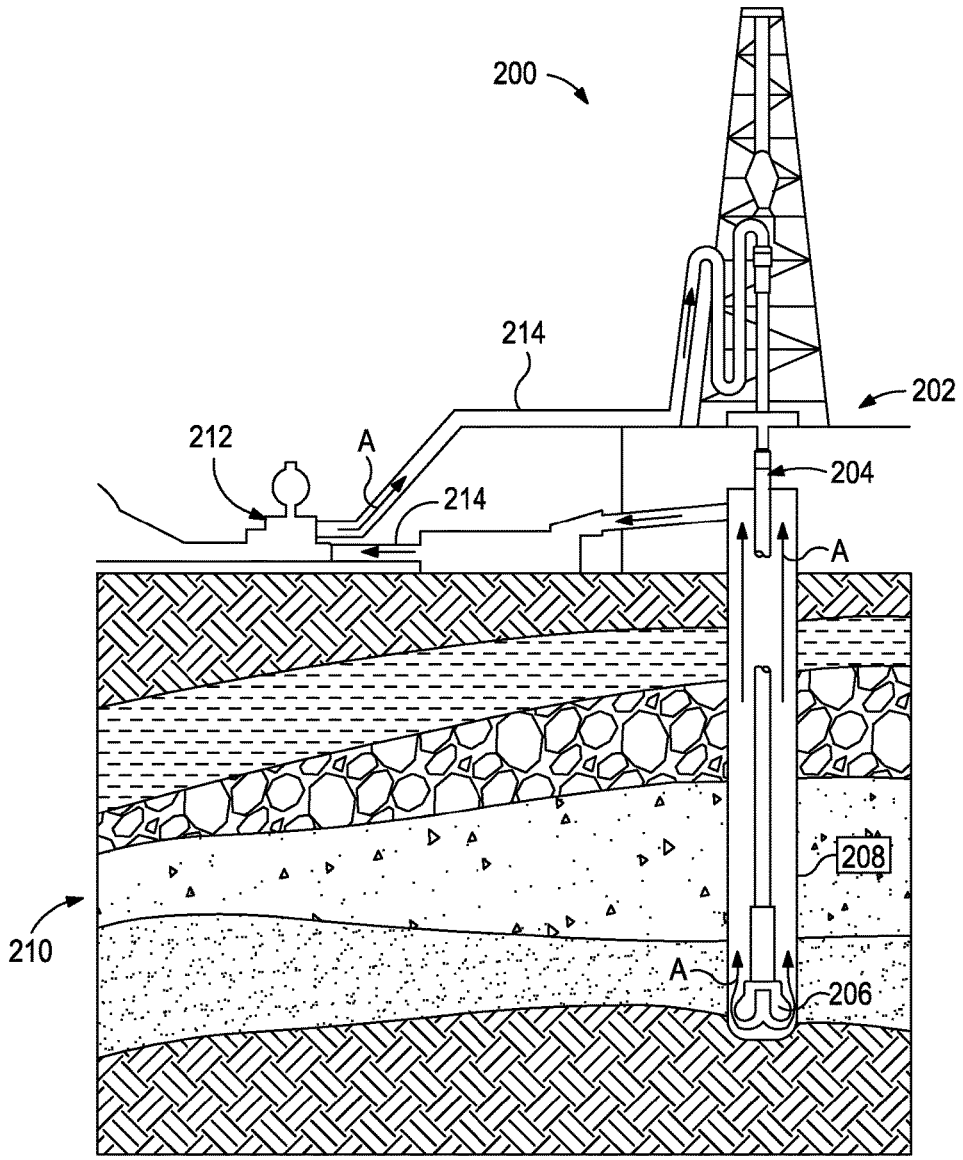
FIG. 5 is a schematic drawing showing one example of a drilling assembly suitable for use in conjunction with the matrix drill bits of the present disclosure.

FIG. 5 is a schematic showing one example of a drilling assembly 200 suitable for use in conjunction with the matrix drill bits of the present disclosure. It should be noted that while FIG. 5 generally depicts a land-based drilling assembly, those skilled in the art will readily recognize that the principles described herein are equally applicable to subsea drilling operations that employ floating or sea-based platforms and rigs, without departing from the scope of the disclosure.

The drilling assembly 200 includes a drilling platform 202 coupled to a drill string 204. The drill string 204 may include, but is not limited to, drill pipe and coiled tubing, as generally known to those skilled in the art apart from the particular teachings of this disclosure. A matrix drill bit 206 according to the embodiments described herein is attached to the distal end of the drill string 204 and is driven either by a downhole motor and/or via rotation of the drill string 204 from the well surface. As the drill bit 206 rotates, it creates a wellbore 208 that penetrates the subterranean formation 210. The drilling assembly 200 also includes a pump 212 that circulates a drilling fluid through the drill string (as illustrated as flow arrows A) and other pipes 214.

One skilled in the art would recognize the other equipment suitable for use in conjunction with drilling assembly 200, which may include, but is not limited to, retention pits, mixers, shakers (e.g., shale shaker), centrifuges, hydrocyclones, separators (including magnetic and electrical separators), desilters, desanders, filters (e.g., diatomaceous earth filters), heat exchangers, and any fluid reclamation equipment. Further, the drilling assembly may include one or more sensors, gauges, pumps, compressors, and the like.

Embodiments disclosed herein include Embodiments A-C.

Embodiment A is a method that includes heat treating a hard composite material at a temperature above a solvus line for the binder material and below a melting point of the binder material, the hard composite material having reinforcing particles dispersed in a binder material; and quenching the hard composite material to a temperature below the solvus line of the binder material to form a precipitation hardened composite material having reinforcing particles and precipitated intermetallic particles dispersed in the binder material, wherein at least some of the precipitated intermetallic particles have at least one dimension less than 1 micron.

Embodiment B is a drill bit that includes a matrix bit body having reinforcing particles and precipitated intermetallic particles dispersed in a binder material, at least some of the reinforcing particles having a diameter of 1 micron or greater, and at least some of the precipitated intermetallic particles having at least one dimension less than 1 micron; and a plurality of cutting elements coupled to an exterior portion of the matrix bit body.

Embodiment C is a system that includes a drill string extendable from a drilling platform and into a wellbore; a pump fluidly connected to the drill string and configured to circulate a drilling fluid into the drill string and through the wellbore; and a drill bit attached to an end of the drill string, the drill bit having a matrix bit body and a plurality of cutting elements coupled to an exterior portion of the matrix bit body, wherein the matrix bit body comprises reinforcing particles and precipitated intermetallic particles dispersed in a binder material, at least some of the reinforcing particles having a diameter of 1 micron or greater, and at least some of the precipitated intermetallic particles having at least one dimension less than 1 micron.

Each of embodiments A, B, and C may have one or more of the following additional elements in any combination: Element 1: wherein less than 10% of the precipitated intermetallic particles by number are located at grain boundaries within the binder material; Element 2: wherein the at least some of the precipitated intermetallic particles have at least one dimension of 1 nm to 1 microns; Element 3: wherein the at least some of the precipitated intermetallic particles have at least one dimension of 1 nm to 100 nm; Element 4: wherein the at least some of the precipitated intermetallic particles have at least one dimension of 5 nm to 50 nm; Element 5: wherein the precipitated intermetallic particles include a transition metal; Element 6: wherein the precipitated intermetallic particles include at least two of manganese, nickel, copper, aluminum, titanium, iron, chromium, zinc, or vanadium; and Element 7: wherein the precipitated intermetallic particles include at least one of: CuM or $Cu_3M$, wherein M is a transition metal selected from the group consisting of manganese, nickel, aluminum, titanium, iron, chromium, zinc, and vanadium.

Each of Embodiments A, B, C may have one or more of the following additional elements in any combination: Element 1 in combination with at least one of Elements 2-4 and optionally at least one of Elements 5-7; Element 1 in combination with at least one of Elements 5-7; and at least one of Elements 2-4 in combination with at least one of Elements 5-7.

Embodiment A may have one or more of the following additional elements in any combination: Element 8: wherein the temperature above the solvus line for the binder material and below the melting point of the binder material is 900° F. to 1500° F.; Element 9: wherein heat treating at the temperature above the solvus line for the binder material and below the melting point of the binder material is for 1 hour to 4 hours; Element 10: wherein quenching the hard composite material occurs in less than 30 minutes; Element 11: wherein quenching the hard composite material occurs in less than 10 minutes; Element 12: the method further including heating the precipitation hardened composite material to a temperature below the solvus line; and growing the precipitated intermetallic particles at the temperature below the solvus line; Element 13: Element 12 wherein the temperature below the solvus line is 10° F. to 50° F. below the solvus line; Element 14: Element 12 wherein the temperature below the solvus line is 500° F. to 1000° F.; and Element 15: Element 12 wherein growing the precipitated intermetallic particles at the temperature below the solvus line is for 1 hour to 10 hours.

By way of non-limiting example, exemplary combinations applicable to Embodiment A include: at least one of Elements 8-15 in combination with at least one of Elements 1-7 including the foregoing combinations thereof; Element 8 in combination with Element 9 and optionally one of Elements 10-11; Element 12 in combination with at least one of Elements 13-15 and optionally one of Elements 10-11; and at least one of Elements 8-9 in combination with at least one of Elements 12-15 and optionally one of Elements 10-11.

One or more illustrative embodiments incorporating the inventive embodiments disclosed herein are presented herein. Not all features of a physical implementation are described or shown in this application for the sake of clarity. It is understood that in the development of a physical embodiment incorporating the embodiments of the present invention, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill the art and having benefit of this disclosure.

To facilitate a better understanding of the embodiments of the present invention, the following examples of preferred or representative embodiments are given. In no way should the following examples be read to limit, or to define, the scope of the invention.

EXAMPLES

Several precipitation hardened composite materials were prepared using a hardened composite material (tungsten carbide reinforcing particles infiltrated with a copper-manganese-nickel binder). The precipitation hardened composite material was heated to a temperature above the solvus line and below the melting point of the binder (the solutioning step) and then rapidly quenched in about 10 minutes or less. The sample was then heated to a temperature below the solvus line of the binder (precipitated particle growth step) for a period of time and then rapidly quenched in about 10 minutes or less. The conditions of the solutioning step and precipitated particle growth step are presented in Table 1 with the approximate precipitated particle sizes as observed via electron microscopy.

TABLE 1

| Sam- | Solutioning Step | Precipitated Particle Growth Step | | Precipitated |
|---|---|---|---|---|
| ple | Temperature | Temperature | Time | Particle Size |
| 1 | 1500° F. | 900° F. | 3 hours | >1 micron |
| 2 | 1500° F. | 680° F. | 3 hours | >1 micron |
| 3 | 1200° F. | 900° F. | 1 hour | <1 micron |
| 4 | 1200° F. | 680° F. | 1 hour | <1 micron |

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed:

1. A drill bit comprising:

a matrix bit body having reinforcing particles and precipitated intermetallic particles dispersed in a binder material, at least some of the reinforcing particles having a diameter of 1 micron or greater, and the precipitated intermetallic particles all have, at least one dimension less than 1 micron, wherein less than 10% of the precipitated intermetallic particles by number are located at grain boundaries within the binder material; and a plurality of cutting elements coupled to an exterior portion of the matrix bit body.

2. The drill bit of claim 1, wherein the at least some of the precipitated intermetallic particles have at least one dimension of 1 nm to 100 nm.

3. The drill bit of claim 1, wherein the at least some of the precipitated intermetallic particles have at least one dimension of 5 nm to 50 nm.

4. The drill bit of claim 1, wherein the precipitated intermetallic particles include a transition metal.

5. The drill bit of claim 1, wherein the precipitated intermetallic particles include at least two of manganese, nickel, copper, aluminum, titanium, iron, chromium, zinc, or vanadium.

6. The drill bit of claim 1, wherein the precipitated intermetallic particles include at least one of: CuM or $Cu_3M$ wherein M is a transition metal selected from the group consisting of manganese, nickel, aluminum, titanium, iron, chromium, zinc, and vanadium.

7. A drilling assembly comprising:

a drill string extendable from a drilling platform and into a wellbore;

a pump fluidly connected to the drill string and configured to circulate a drilling fluid into the drill string and through the wellbore; and a drill bit attached to an end of the drill string, the drill bit having a matrix bit body and a plurality of cutting elements coupled to an exterior portion of the matrix bit body, wherein the matrix bit body comprises reinforcing particles and precipitated intermetallic particles dispersed in a binder material, at least some of the reinforcing particles having a diameter of 1 micron or greater, and the precipitated intermetallic particles all have at least one dimension less than 1 micron, wherein less than 10% of the precipitated intermetallic particles by number are located at grain boundaries within the binder material.

8. The drilling assembly of claim 7, wherein the at least some of the precipitated intermetallic particles have at least one dimension of 1 nm to 100 nm.

9. The drilling assembly of claim 7, wherein the at least some of the precipitated intermetallic particles have at least one dimension of 5 nm to 50 nm.

* * * * *